US012213540B2

(12) United States Patent
Joannou

(10) Patent No.: US 12,213,540 B2
(45) Date of Patent: Feb. 4, 2025

(54) GARMENT WITH EMBELLISHED BACK STRAP

(71) Applicant: Ariane Joannou, La Jolla, CA (US)

(72) Inventor: Ariane Joannou, La Jolla, CA (US)

( * ) Notice: Subject to any disclaimer, the term of this patent is extended or adjusted under 35 U.S.C. 154(b) by 1008 days.

(21) Appl. No.: 14/796,959

(22) Filed: Jul. 10, 2015

(65) Prior Publication Data

US 2017/0006926 A1 Jan. 12, 2017

(51) Int. Cl.

| | |
|---|---|
| ***A41D 27/08*** | (2006.01) |
| ***A41C 3/06*** | (2006.01) |
| ***A41F 1/00*** | (2006.01) |

(52) U.S. Cl.

CPC ..... *A41C 3/06* (2013.01); *A41D 27/08* (2013.01); *A41F 1/006* (2013.01)

(58) Field of Classification Search

CPC .. A41C 3/06; A41C 3/00; A41C 3/106; A41F 1/006; A41D 27/08

USPC ..... 450/82, 79

See application file for complete search history.

(56) References Cited

U.S. PATENT DOCUMENTS

| | | | | |
|---|---|---|---|---|
| 2,530,829 | A * | 11/1950 | Licht | A41C 3/08 2/73 |
| 2,595,088 | A * | 4/1952 | Licht | A41C 3/0007 450/52 |
| 2,869,552 | A * | 1/1959 | Smith | A41C 3/06 450/32 |
| 3,334,632 | A * | 8/1967 | Rashkin | A41F 1/006 450/77 |
| 3,848,270 | A | 11/1974 | Rand | |
| 6,282,725 | B1 | 9/2001 | Vanidestine, Jr. | |
| 6,336,839 | B1 | 1/2002 | Valli | |
| D465,637 | S | 11/2002 | Marco et al. | |
| 6,857,936 | B2 * | 2/2005 | Jones | A41F 15/002 450/86 |
| D519,261 | S | 4/2006 | Reis | |
| 7,033,244 | B1 * | 4/2006 | Barton | A41C 3/04 450/36 |
| 7,238,081 | B2 | 7/2007 | Fildan et al. | |
| D577,476 | S | 9/2008 | Hyde | |
| D578,277 | S * | 10/2008 | Lung | D2/706 |
| D578,733 | S | 10/2008 | Samuels et al. | |
| D580,819 | S | 11/2008 | Samuels et al. | |
| 8,439,722 | B2 * | 5/2013 | Buriak | A41C 3/02 450/71 |
| 8,469,772 | B2 | 7/2013 | Crouch | |

(Continued)

*Primary Examiner* — Alissa J Tompkins
*Assistant Examiner* — Catherine M Ferreira
(74) *Attorney, Agent, or Firm* — Fenwick & West LLP

(57) ABSTRACT

A garment comprising a front portion; a back portion; the front portion and the back portion converging to define a first edge section and a second edge section; a first attachment device having a first opening located in proximity to the first edge section; a second attachment device having a second opening located in proximity to the second edge section; the first and second openings extend from the front portion to the back portion; an embellished back strap having a first surface a second surface, a first attachment portion, and a second attachment portion; the first attachment portion loops through the first opening and the second attachment portion loops through the second opening; and an adjustable attachment system for attaching the first and second attachment portions to the second face of the embellished strap.

16 Claims, 8 Drawing Sheets

(56) References Cited

U.S. PATENT DOCUMENTS

| | | | | |
|---|---|---|---|---|
| D709,670 | S * | 7/2014 | Vericella | D2/708 |
| 9,462,833 | B1 * | 10/2016 | Spaulding | A41D 7/00 |
| 2003/0236054 | A1 * | 12/2003 | Chen | A41F 15/002 450/82 |
| 2007/0123148 | A1 | 5/2007 | Heer | |
| 2009/0075562 | A1 * | 3/2009 | Lung | A41C 3/12 450/86 |
| 2009/0144924 | A1 * | 6/2009 | Stein | A47K 10/02 15/210.1 |
| 2009/0215360 | A1 | 8/2009 | Brideson | |
| 2011/0269376 | A1 * | 11/2011 | Clim | A41F 15/00 450/86 |
| 2012/0028539 | A1 | 2/2012 | McCarty | |
| 2012/0208432 | A1 | 8/2012 | Dimond et al. | |
| 2012/0324631 | A1 * | 12/2012 | Peper | A41F 15/02 2/244 |
| 2016/0249688 | A1 * | 9/2016 | Ibey | A41C 3/12 450/88 |

* cited by examiner

GARMENT WITH EMBELLISHED BACK STRAP

CROSS-REFERENCE TO RELATED APPLICATIONS

N/A

BACKGROUND OF THE INVENTION

Field of the Invention

The present invention relates generally to support garments, brassieres, bandeaus, or the like. More particularly, the present invention relates to a garment with an embellished back strap for replacing or covering an existing garment back strap.

Description of Related Art

In the art of brassieres or bras, when a woman wears an article of clothing it is generally considered unsightly and unfashionable for any portion of the bra to be visible. In some instances, the article of clothing is a backless dress, or backless blouse exposing the woman's back. When this variety of clothing is worn, a typical bra's back strap would be visible.

Currently, there are known bras to overcome this issue. One bra in particular, called a backless bra or adhesive bra, has no back straps. Thus, it can be worn with backless articles of clothing. However, this bra type is not without its disadvantages. Specifically, this bra is not reliable in staying affixed to the woman, as it relies on an adhesive system to stay in place which my lose effectiveness over time. Also, in some instances women develop allergic reactions and rashes related to the compounds used in the adhesive system. Consequently, there is a need for a bra that can be worn with backless articles of clothing, while providing comfort, femininity, and fashion.

BRIEF SUMMARY OF THE INVENTION

In one embodiment of the present invention a garment for covering the chest of a woman is provided comprising a front portion; a back portion; the front portion and the back portion converging to define a first edge section and a second edge section; a first attachment device having a first opening located in proximity to the first edge section; a second attachment device having a second opening located in proximity to the second edge section; the first and second opening extending from the front portion to the back portion; an embellished back strap designed to encircle the back of the woman having a first surface, a second surface, a first attachment portion, and a second attachment portion; the first attachment portion loops through the first opening and the second attachment portion loops through the second opening; and an adjustable attachment system for attaching the first and second attachment portions to the second face of the embellished strap.

In one embodiment the front and back portions are made of a fabric material; and the first and second attachment devices are stitched into the fabric. In another embodiment, a pair of reinforcement members made of a rigid material is provided; and the pair of reinforcement members is woven into the fabric surrounding the first and second attachment devices. In yet another embodiment, a pair of stiffening elements made of a rigid material is provided; and the pair of stiffening elements is affixed to the first and second edge sections.

In one embodiment the embellished back strap is made of an elastic material, and the first surface comprises a plurality of jewelry ornaments. In another embodiment, the first surface is made of a non-elastic material; the second surface and first and second attachment portions are made from an elastic material. In yet another embodiment, the adjustable attachment system is selected from the group consisting of a hook-and-eyelet closure, a button fastener, a clamp, a swimsuit clip, a clasp device, a grommet hook, a snap fastener, a Velcro fastener, and a magnet fastener.

In one embodiment, the embellished back strap and the attachment system are positioned such that: the first surface is visible when a backless article of clothing is worn by the woman; and the second surface, the first and second portions, and the attachment system are not visible when the backless article of clothing is worn by the woman. In one embodiment, the garment is a brassiere. In another embodiment, the garment is a bandeau.

In another aspect of the invention a method is provided, comprising steps (a) providing an existing brassiere, the existing brassiere comprising a pair of support cups, a first edge section, a second edge section, a first existing back strap, and a second existing back strap; the first existing back strap extending from the first edge section, and the second existing back strap extending from the second edge section; (b) providing an embellished back strap comprising a first surface, a second surface, a first elastic attachment portion, and a second elastic attachment portion; the second surface comprising an adjustable attachment mechanism for connecting the first and second elastic attachment portions to the second surface. (c) folding the first and second existing back straps into the pair of support cups; (d) placing a first attachment device on the first edge section and a second attachment device on the second edge section, the first and second attachment devices comprising a clamp portion and an aperture portion; (e) feeding the first and second elastic attachment portions through the aperture portion of the first and second attachment device; and (f) attaching the embellished back strap to the existing garment by use of the adjustable attachment mechanism.

In one embodiment, in step (b), the first surface comprises a plurality of jewelry ornaments. In another embodiment, in step (b), the adjustable attachment mechanism is selected from the group consisting of a hook-and-eyelet closure, a button fastener, a clamp, a swimsuit clip, a clasp device, a grommet hook, a snap fastener, a Velcro fastener, and a magnet fastener. Also in one embodiment there is further a step in which the existing garment with the attached embellished back strap is worn by a woman with an article of clothing which exposes the back of the woman such that: the first surface is visible; and the second surface, the first and second elastic attachment portions, and the adjustable attachment mechanism are not visible.

In yet another aspect of the invention a new and improved back strap for female garments is provided comprising a first surface; a second surface; a first attachment portion; a second attachment portion; the first surface having an embellished portion; an adjustable attachment mechanism for attaching the first and second attachment portions to the second face; the adjustable attachment mechanism designed for the attachment of the back strap to the female garments.

In one embodiment, the first surface is made of a non-elastic material; wherein the second surface and first and second attachment portions are made from an elastic material. Also in one embodiment, the first surface is made from a material selected from the group consisting of synthetic fabrics, denim, cotton, leather, plastic, stone, rubber, polyester, satin, suede, natural and/or synthetic fur, vinyl, metal, silk, and combinations thereof. In another embodiment, the embellished portion comprises a plurality design features. Yet in another embodiment, the plurality of design features is selected from the group consisting of jewelry ornaments, indicia, and artistic renderings. Further in one embodiment, the adjustable attachment mechanism is selected from the group consisting of a hook-and-eyelet closure, a button fastener, a clamp, a swimsuit clip, a clasp device, a grommet hook, a snap fastener, a Velcro fastener, and a magnet fastener.

Such stated summary and advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE SEVERAL VIEWS OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments. Referring to the drawings in which like reference character(s) present corresponding part(s) throughout.

DETAILED DESCRIPTION OF THE INVENTION

In one embodiment of the instant invention the inventor provides a garment with an embellished back strap intended to replace or cover an existing back strap. The embellished back strap adds femininity and fashion to the garment, while allowing the garment to be worn with an article of clothing that exposes the back of the wearer. The detailed description set forth below in connection with the appended drawings is intended as a description of presently preferred embodiments of the invention and is not intended to represent the only forms in which the present invention may be constructed and or utilized.

Figure 1:
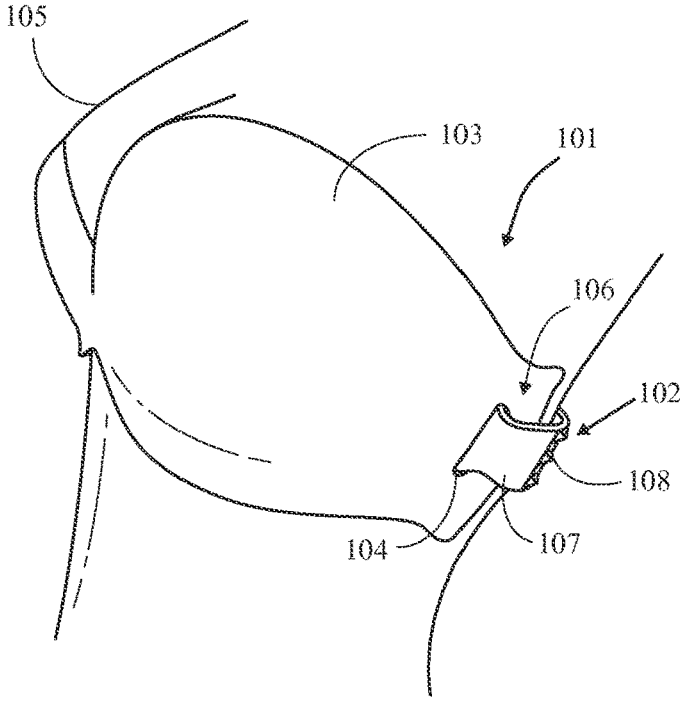
FIG. 1 is an exemplary perspective view illustrating the front of a garment with an embellished back strap worn on a woman according to an embodiment of the present invention.

FIG. 1 is an exemplary perspective view illustrating the front of a garment 101 with an embellished back strap 102 worn on a woman according to an embodiment of the present invention. The garment comprises a front portion 103 and a slit 104, it is to be understood that "slit" may refer to any shaped opening (e.g. circular, oval, rectangular) and is non-limiting. The garment is worn around a torso of a woman 105, and the front portion may include two cups as well known in the art. The embellished back strap comprises an attachment portion 107 and embellished portion 108. The slit 104 allows for the attachment portion to be fashioned to the garment. The slit 104 is positioned on an edge section 106 of the front portion. Although one slit 104 is illustrated, it is understood that an identical second slit is positioned on a second edge section 106 of the front portion at an opposing location. In this particular exemplary instance, the garment is a brassiere, but it understood that the garment may be any type of garment worn on the torso of a woman including but not limited to a bandeau, a bralette, and a swimwear top.

Figure 2:
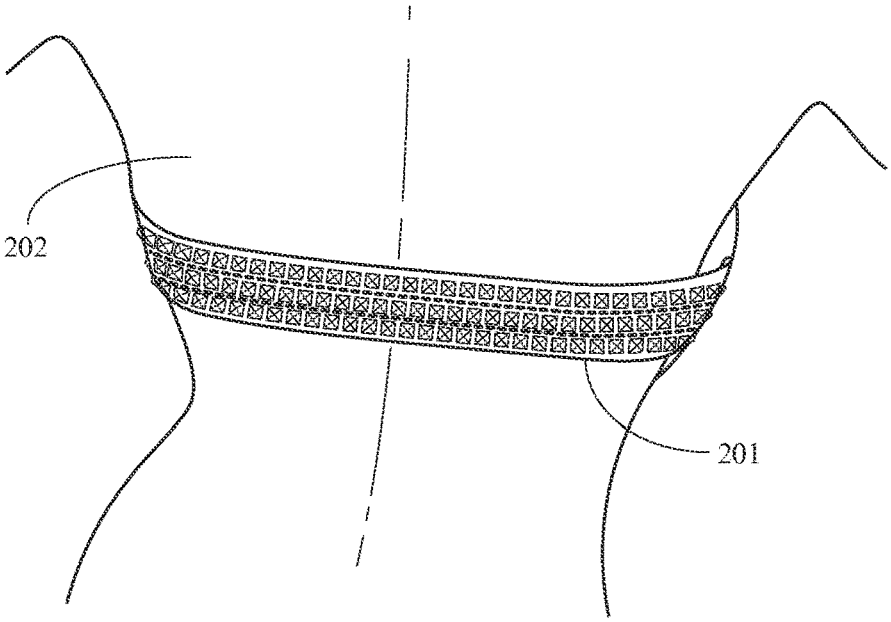
FIG. 2 is an exemplary perspective view illustrating the back of a garment with an embellished back strap worn on a woman according to an embodiment of the present invention.

FIG. 2 is an exemplary perspective view illustrating the back of a garment with an embellished back strap 201 worn on a woman according to an embodiment of the present invention. The embellished back strap is fitted across a woman's back 202. The embellished back strap is made from an elastic material and features a plurality of design features, such as jewelry ornaments as shown. The elastic material is critical and aids in supporting the garment in a fixed position, while providing comfort to the wearer. The plurality of design features may include any ornamental design, such as designs typically provided on belts and necklaces. An inventive feature of the instant invention includes the ability to interchange different embellished back strap designs depending on fashion requirements and the mood of the wearer such that the attachment portion is hidden whilst wearing a backless top. The design features will be described in greater detail below.

Figure 3A:
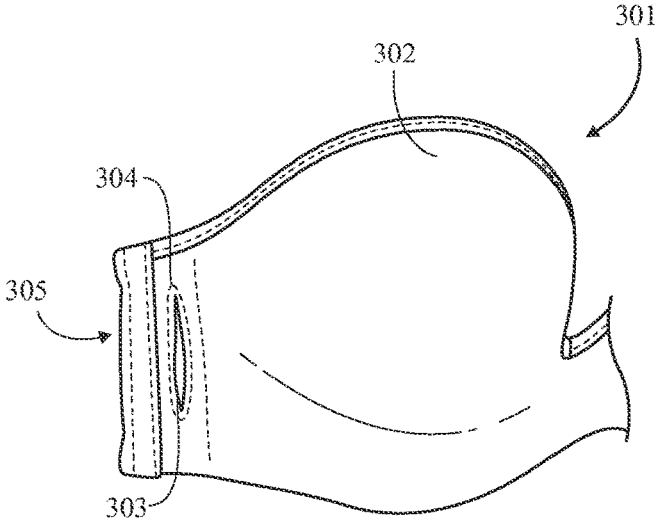
FIGS. 3A-C are exemplary detail views illustrating components of a garment according to an embodiment of the present invention.
Figure 3B:
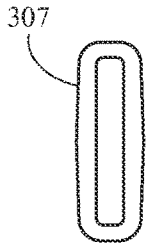
Figure 3C:
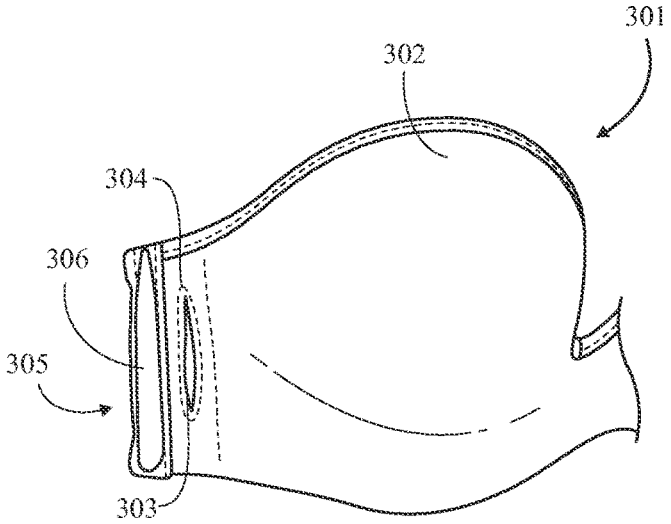

FIGS. 3A-C are exemplary detail views illustrating components of a garment according to an embodiment of the present invention. In FIG. 3, a portion of a garment 301 is illustrated. The garment comprises front portion 302 and slit 303. The slit is positioned on edge section 305 of the front portion, and is reinforced with a double stitched seam 304 providing reinforcement to the slit. In some embodiments further reinforcement device are provided.

Referring now to FIG. 3B, reinforcement member 307 is illustrated. The reinforcement member 307 having an elongated rectangular shape is designed to be stitched into fabric surrounding slit 304 (FIG. 3A), it being understood that the rectangular shape is only exemplary and other shapes, e.g.

circular rings or oval members, may be substituted therefor. This improves reinforcement to the slit and edge section of the garment as the embellished back strap is attached and exhibiting a tension force to the slit while in use. The reinforcement member is made from a solid rigid material such as a ridged polymer or metal.

In FIG. 3C, a portion of a garment 301 is illustrated. The garment comprises front portion 302 and slit 303. The slit is positioned on edge section 305 of the front portion, and is reinforced with a double stitched seem 304 providing reinforcement to the slit. In some embodiments, an additional reinforcement device 306 is provided. In this particular exemplary instance, the additional reinforcement device 306 is a stiffening element or stay, made from a rigid material such as a ridged polymer or metal. The additional reinforcement device provides additional reinforcement to the slit and edge section of the garment as the embellished back strap is attached and exhibiting a tension force to the slit while in use. In some embodiments, both reinforcement member 307 (FIG. 3B) and the additional reinforcement device 306 may be used in conjunction for improved reinforcement.

Figure 4A:
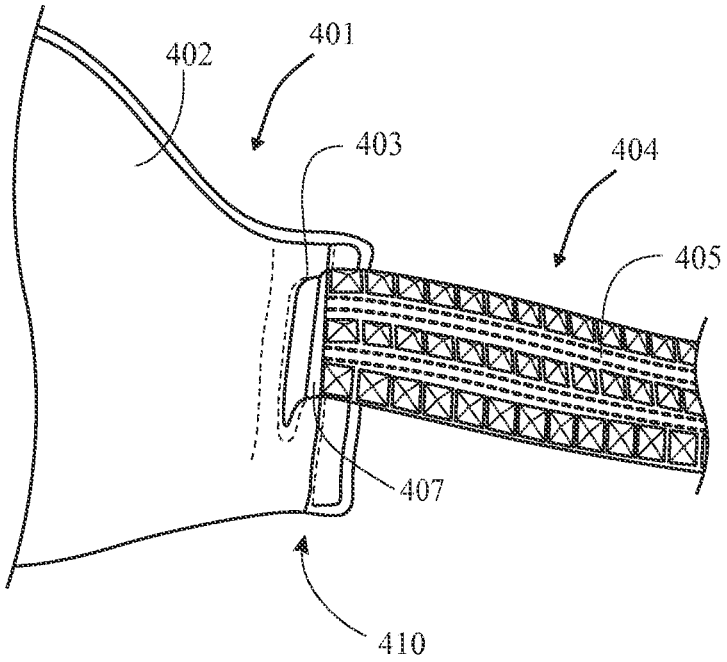
FIGS. 4A-B are exemplary detail views illustrating components of a garment with an embellished back strap according to an embodiment of the present invention.
Figure 4B:
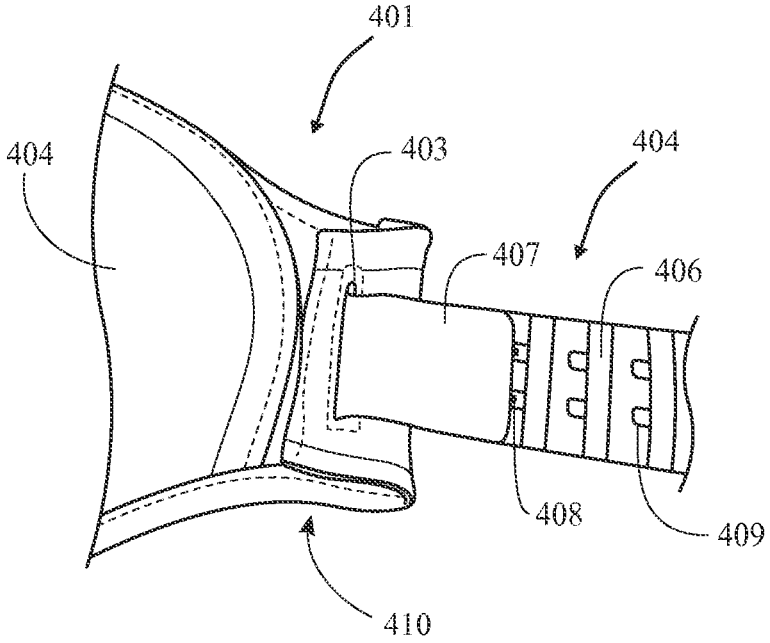

FIGS. 4A-B are exemplary detail views illustrating components of a garment 401 with an embellished back strap 404 according to an embodiment of the present invention. Referring to FIG. 4A, a front detail view of the garment is illustrated. The garment comprises front portion 402 and slit 403. The slit allows for the embellished back strap to be fashioned to the garment. The embellished back strap includes an attachment portion 407 and embellished portion 405, the embellished portion features a plurality of design features, such as jewelry ornaments, indicia (e.g. Nike®, Adidas®, Under Armour®), or artistic renderings. The attachment portion is made from an elastic material, while the embellished portion may include layers of material from a variety of materials including but not limited to leather and denim. The details of the design features and material options will be described in greater detail below.

Referring now to FIG. 4B, a back detail view of the garment is illustrated. This view is not visible during use, and is shown for illustrative purposes only. The garment comprises a back portion 404 and slit 403. The slit allows for the embellished back strap to be fashioned to the garment. The embellished back strap includes an attachment portion 407, a nonvisible back side 406, and adjustable attachment mechanism 408/409. The adjustable attachment mechanism allows for the adjustment and attachment of the embellished back strap to be fashioned to the garment. The adjustable attachment mechanism includes the attachment portion 407, hooks 408, and a plurality of eyelet loops 409. The plurality of eyelet loops are positioned at varying lengths along the nonvisible back side of the embellished back strap, allowing for the engagement with the hooks. The adjustable attachment mechanism allows the garment and embellished back strap to be tightened or loosened as needed, as well as the ability to interchange different embellished back strap designs depending on fashion requirements and the mood of the wearer. Additionally, the availability of attachment mechanisms 408/409 at both opposing slits further advances appropriate fit as desired by the user.

In this particular exemplary instance, the adjustable attachment mechanism is a hook and eyelet fashioning method, but it understood that the adjustable attachment mechanism may be any type of adjustable attachment mechanism including but not limited to garter clamps, grommet hooks, snaps, buttons, Velcro hooks, and magnets. Although one slit and adjustable attachment mechanism is illustrated on an edge section 410, it is understood that an identical second slit and an identical second attachment mechanism is positioned on a second edge section of the garment. Therefore, the adjustable attachment mechanism can be utilized on either side of the garment or both sides.

Figure 5A:
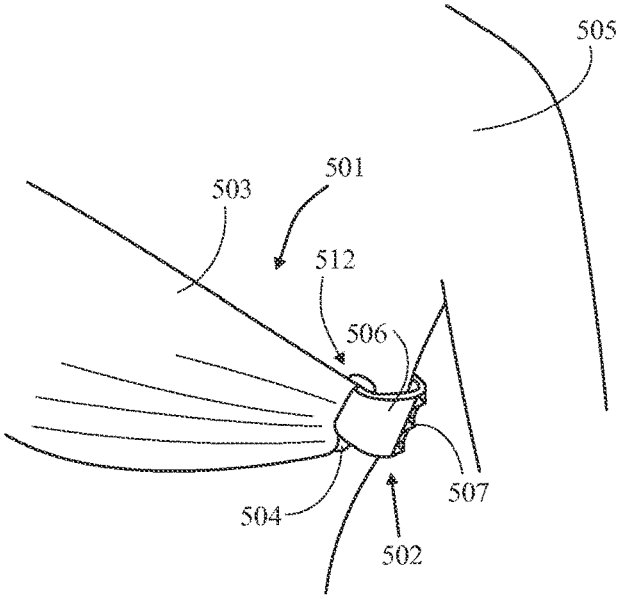
FIGS. 5A-C are exemplary detail views illustrating components of a garment with an embellished back strap according to an embodiment of the present invention.
Figure 5B:
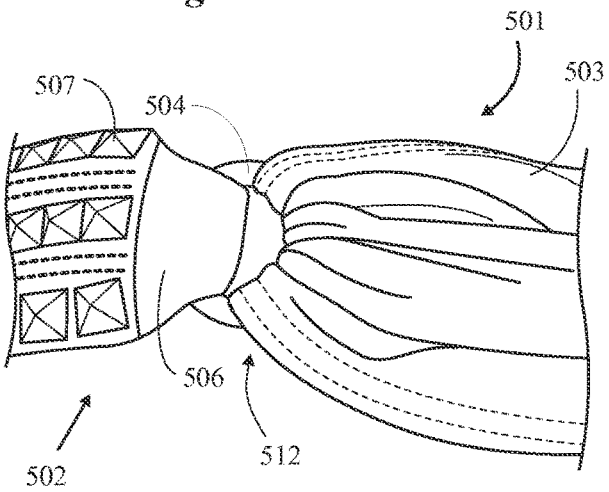
Figure 5C:
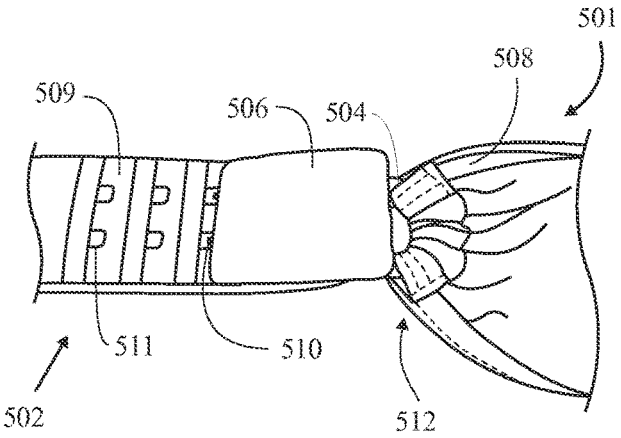

FIGS. 5A-C are exemplary detail views illustrating components of a garment 501 with an embellished back strap 502 according to an embodiment of the present invention. Referring to FIG. 5A, the garment worn on a woman 505 is illustrated. The garment comprises front portion 503 and aperture portion 504. The embellished back strap comprises an attachment portion 506 and embellished portion 507. The aperture portion 504 allows for the attachment portion to be fashioned to the garment. The aperture portion 504 is positioned on an edge section 512 of the front portion. Although one aperture portion 504 is illustrated, it is understood that an identical second aperture portion is positioned on a second edge section of the front portion. In this particular exemplary instance, the garment is a bandeau, but it understood that the garment may be any type of garment worn on the torso of a woman including but not limited to a brassier, a bralette, and a swimwear top.

Referring to FIG. 5B, a front detail view of the garment is illustrated. The garment comprises front portion 503 and aperture portion 504. The aperture portion allows for the embellished back strap to be fashioned to the garment. The embellished back strap includes an attachment portion 506 and embellished portion 507, the embellished portion features a plurality of design features, such as jewelry ornaments. The attachment portion is made from an elastic material, while the embellished portion may include layers of material from a variety of materials including but not limited to leather and denim. The details of the design features and material options will be described in greater detail below.

Referring now to FIG. 5C, a back detail view of the garment is illustrated. This view is not visible during use, and is shown for illustrative purposes only. The garment comprises a back portion 508 and aperture portion 504. The aperture portion allows for the embellished back strap to be fashioned to the garment. The embellished back strap includes an attachment portion 506, a nonvisible back side 509, and adjustable attachment mechanism 510/511. The adjustable attachment mechanism allows for the adjustment and attachment of the embellished back strap to be fashioned to the garment. The adjustable attachment mechanism includes the attachment portion 506, hooks 510, and a plurality of eyelet loops 511. The plurality of eyelet loops are positioned at varying lengths along the nonvisible back side of the embellished back strap, allowing for the engagement with the hooks and corresponding attachment strap as well known in the art. The adjustable attachment mechanism allows the garment and embellished back strap to be tightened or loosened as needed, as well as the ability to interchange different embellished back strap designs depending on fashion requirements and the mood of the wearer.

In this particular exemplary instance, the adjustable attachment mechanism is a hook and eyelet fashioning method, but it understood that the adjustable attachment mechanism may be any type of adjustable attachment mechanism including but not limited to garter clamps, grommet hooks, snaps, buttons, Velcro hooks, and magnets. Although one aperture portion and adjustable attachment mechanism is illustrated on an edge section 512, it is understood that an identical second aperture portion and an identical second attachment mechanism is positioned on a second edge section of the garment. Therefore, the adjustable attachment mechanism can be utilized on either side of the garment.

Figure 6A:
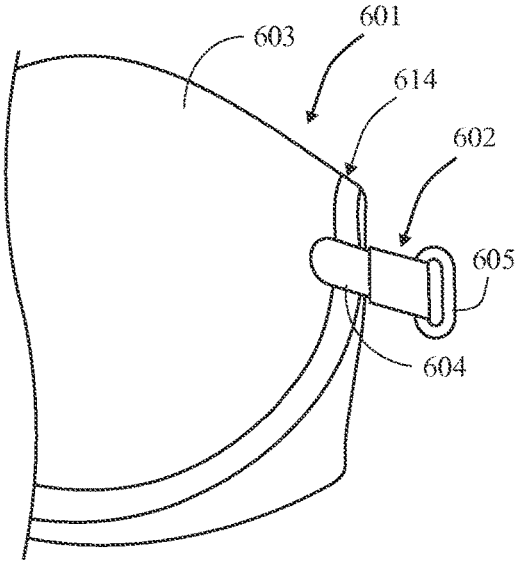
FIGS. 6A-D are exemplary detail views illustrating a method for adding an embellished back strap to an existing garment according to an embodiment of the present invention.

FIGS. 6A-D are exemplary detail views illustrating a method for adding an embellished back strap 609 to an existing garment 601 according to an embodiment of the present invention. For simplicity, only one side of the existing garment is illustrated, but it should be understood that an identical process as described below is performed on the other side of the existing garment. Referring to FIG. 6A, a front detail view of the existing garment is illustrated. The exiting garment comprises a front portion 603 and an edge portion 614. The existing garment may be any type of garment including but not limited to a brassier, a bandeau, a bralette, and a swimwear top. The existing garment is illustrated without shoulder straps, but the current invention may also be used with garments having shoulder straps. A first step for adding an embellished back strap to the existing garment is the placement of an attachment device 602, such as a clip or a garter clamp. The attachment device comprises a first clamp 604 and an attachment device 605. The attachment device is clipped to the edge portion of the existing garment. The placement allows for the attachment device not to be visible during use.

Figure 6B:
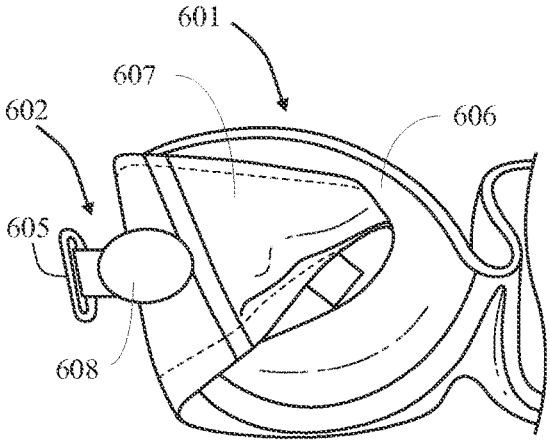

Referring now to FIG. 6B, a back detail view of the existing garment is illustrated. The existing garment comprises a back portion 606 and an existing back strap 607. While performing the first step for adding the embellished back strap to the existing garment, that the existing back strap should be folded back prior to clipping the attachment device on the edge portion of the existing garment. This is best illustrated in the current view. Also, in this view it can be seen that the attachment device comprises a second clamp having a rounded cushion 608. The rounded cushion is made from a gel-like material offering improved comfort for the wearer. The embellished back strap 102 may also be attached over an existing brassiere back strap to obfuscate the same using attachment device 102. For example, instead of folding back the bra strap, it can be worn in a normal fashion and the first clamp 604 can be clamped onto a portion of the existing bra, with a mirroring attachment on the opposing side such that the embellished back strap 102 lies over the brassiere's backstrap.

Figure 6C:
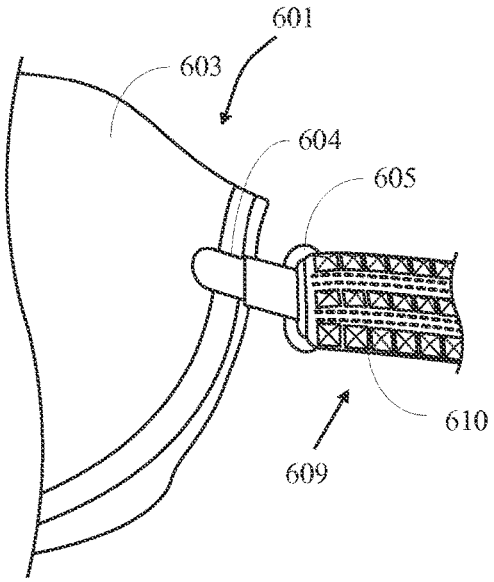

FIG. 6C illustrates a front detail view of an existing garment. A second step for adding the embellished back strap to the existing garment is the placement of the embellished back strap. Embellished back strap 609 comprises an embellished portion 610 featuring a plurality of design features, such as jewelry ornaments. The embellished back strap is made from an elastic material which aids in supporting the existing garment in a fixed position, while providing comfort to the wearer. The placement of the embellished back strap to the existing garment requires the embellished portion of the embellished back strap to be fed into attachment device 605 of the attachment device. It is important to verify that the embellished portion is facing the wearer as seen in this detail view, ensuring the embellished portion is visible as intended.

Figure 6D:
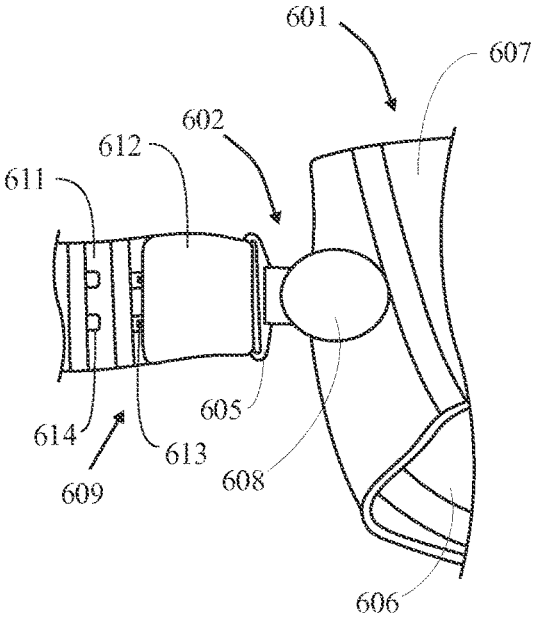

Referring now to FIG. 6D, a back detail view of the existing garment is illustrated. A third step for adding the embellished back strap to the existing garment is the attachment of the embellished back strap. Embellished back strap 609 includes an attachment portion 612, a nonvisible back side 611, and an adjustable attachment mechanism 612/613/614. The adjustable attachment mechanism allows for the adjustment and attachment of the embellished back strap to be fashioned to the existing garment. The adjustable attachment mechanism includes the attachment portion 612, hooks 613, and a plurality of eyelet loops 614. The plurality of eyelet loops are positioned at varying lengths along the nonvisible back side of the embellished back strap, allowing for the engagement with the hooks and corresponding attachment strap as well known in the art. The adjustable attachment mechanism allows embellished back strap to be tightened or loosened as needed, as well as the ability to interchange different embellished back strap designs depending on fashion requirements and the mood of the wearer.

In this particular exemplary instance, the adjustable attachment mechanism is a hook and eyelet fashioning method, but it is understood that the adjustable attachment mechanism may be any type of adjustable attachment mechanism including but not limited to grommet hooks, snaps, buttons, Velcro hooks, and magnets.

Figure 7:
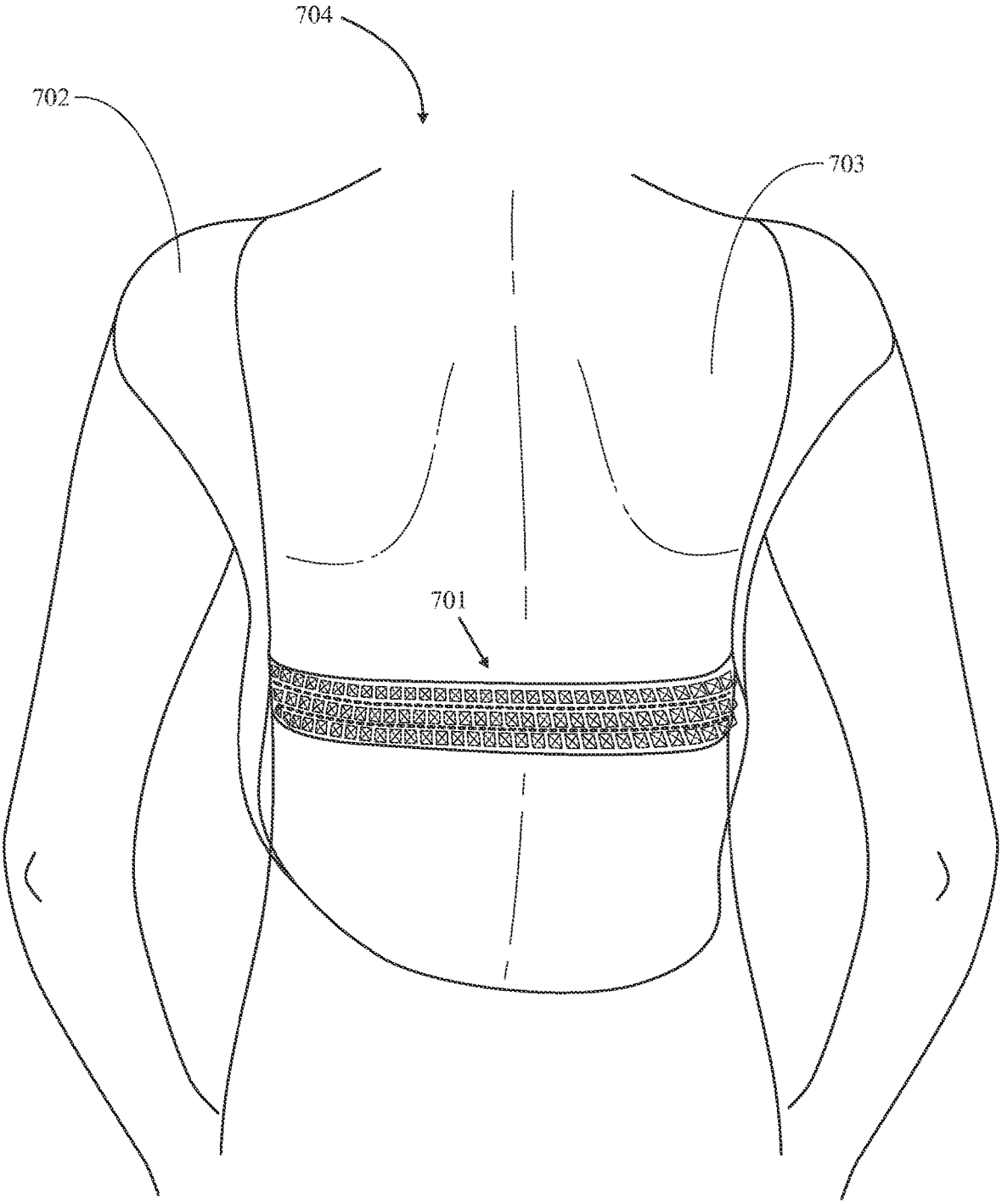
FIG. 7 is an exemplary perspective view illustrating the back of a garment with an embellished back strap worn on a woman according to an embodiment of the present invention.

FIG. 7 is an exemplary perspective view illustrating the back of a garment with an embellished back strap 701 worn on a woman 704 according to an embodiment of the present invention. An inventive feature of the present invention, allows for the garment to be worn with a backless article of clothing 702, exposing the woman's back 703 and embellished back strap. The embellished back strap adds femininity and fashion to the ensemble while providing more support and security than a backless bra, which requires the use of adhesives to stay affixed to the woman while in use. It is important to note that the garment and attachment device 602 (FIGS. 6A-D) are not visible while the backless article of clothing is worn by the woman.

Figure 8A:
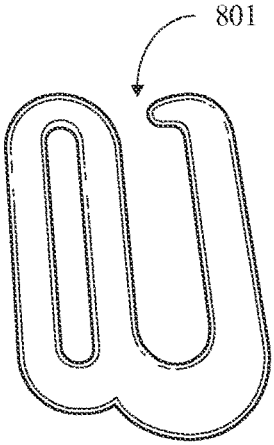
FIGS. 8A-B are exemplary detail views of attachment devices according to some embodiments of the present invention.
Figure 8B:
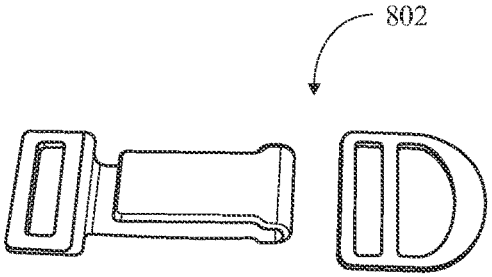

FIGS. 8A-B are exemplary detail views of attachment devices according to some embodiments of the present invention. As mentioned previously, the adjustable attachment mechanism (FIGS. 4B/5C/6D) is a hook and eyelet fashioning method, however other attachment mechanism may be used including a swimsuit clip 801 and a clasp device 802.

Figure 9A:
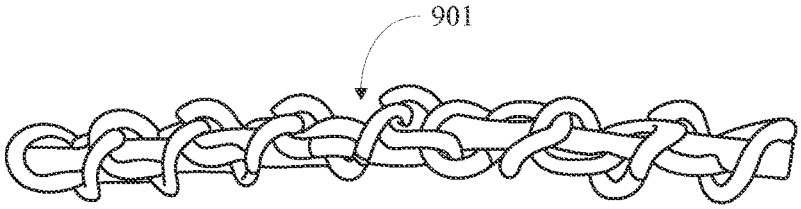
FIGS. 9A-C are exemplary detail views illustrating a plurality of design features on an embellished back strap according to some embodiments of the present invention.
Figure 9B:
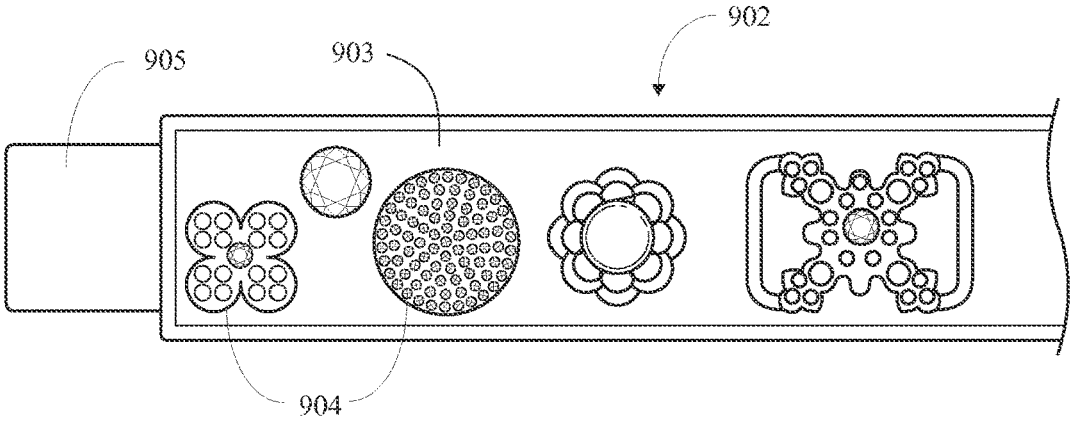
Figure 9C:
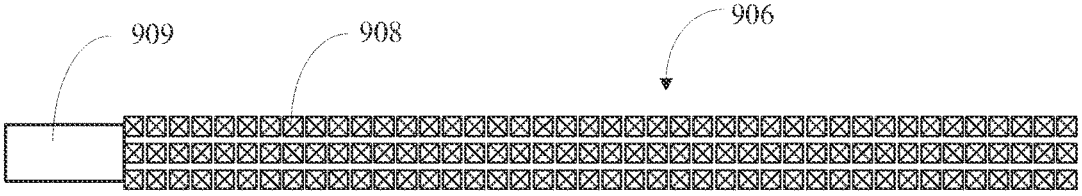

FIGS. 9A-C are exemplary detail views illustrating a plurality of design features on an embellished back strap according to some embodiments of the present invention. As mentioned previously, the plurality of design features may include any ornamental design, such as designs typically provided on belts and necklaces. An inventive feature of the instant invention includes the ability to interchange different embellished back strap designs depending on fashion requirements and the mood of the wearer. FIG. 9A illustrates an embellished back strap 901 made from a chain design. The chain design includes a flexible series of metal links as known in the art.

FIG. 9B illustrates an embellished back strap 902 including a layer of material 903 and a plurality of jewelry ornaments 904. The layer of material may be any type material, including but not limited to synthetic fabrics, denim, cotton, leather, plastic, stone, rubber, polyester, satin, suede, natural and/or synthetic fur, vinyl, metal, silk, and combinations thereof. The layer of material may also contain any color from the known colors in the art. The plurality of jewelry ornaments may include various shapes that feature gemstones and precious metals. The layer of material is backed by an attachment portion 905, made of an elastic material which is used to attach the embellished back strap to a garment as described above.

FIG. 9C illustrates an embellished back strap 906 comprising an interconnected plurality of jewelry ornaments 908. The plurality of jewelry ornaments may be interconnected with elastic string or cord known in the art for creating a single piece of jewelry that is elastic. Likewise, the plurality of jewelry ornaments may be affixed to a layer of material as seen in FIG. 9B. The single piece of jewelry is connected to an attachment portion 909, made of an elastic material which is used to attach the embellished back strap to a garment as described above.

Figure 10:
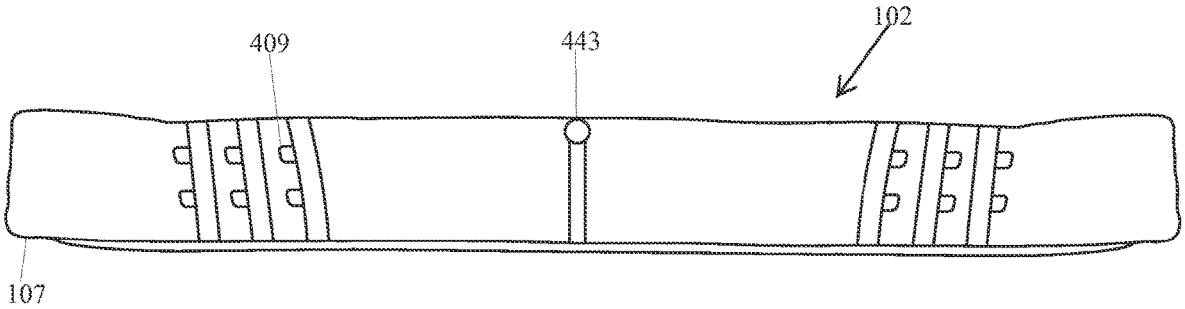
FIG. 10 is an exemplary detail view illustrating components of an embellished back strap according to an embodiment of the present invention

FIG. 10 illustrates an alternate embodiment of an embellished back strap 102 for replacing or covering an existing garment back strap, wherein strap 102 has two opposing and mirroring attachment portions 107 that include hooks 408 and eyelet loops 409 connecting to the existing edge portion 614 of the garment, and further includes a substantially medially located affixing mechanism 443 that engages an existing brassiere strap to obfuscate and embellish the same.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, the aperture portion and slit refer to defined openings and should not be limited to the ordinary shapes of the openings. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A bra garment without arm straps, the bra garment configured for covering a chest of a wearer, the bra garment comprising:

a pair of support cups comprising:

a first edge section and a second edge section at opposing distal ends of the pair of support cups, wherein the first edge section is positioned adjacent to a first support cup of the pair of support cups, and the second edge section is positioned adjacent to a second support cup of the pair of support cups; and a first opening located on the first edge section, and a second opening located on the second edge section at an opposing location, wherein each of the first edge section and the second edge section comprises a rigid material that provides reinforcement to the corresponding edge section and to the corresponding opening located on the edge section; and a back strap composed of an elastic portion and non-elastic portion comprising:

the elastic portion made of an elastic material, each end of the elastic portion having at least one hook and a set of loops positioned proximal to the hook; and the non-elastic portion made of a non-elastic material that is embellished, the embellished non-elastic portion designed to be positioned on top of the elastic portion when worn, the embellished non-elastic portion adjustably attached to the elastic portion, wherein the hook on each end of the elastic portion is configured to be fed through the first and second openings, respectively, of the pair of support cups and to be fastened back to one of the loops on the elastic portion positioned proximal to the hook, the fastening of each of the hooks providing an elastic connection to hold up the bra garment while also creating a tension force to position the embellished non-elastic portion to cover the elastic portion when the bra garment is worn.

2. The bra garment of claim 1, wherein the bra garment is made of a fabric material.

3. The bra garment of claim 1, wherein the embellished non-elastic portion comprises a plurality of jewelry ornaments.

4. The bra garment of claim 1, wherein the embellished non-elastic portion is positioned to be visible within an exposed portion of the back of the wearer when a backless article of clothing is worn, and wherein each of the hooks and the sets of loops are located behind either the embellished non-elastic portion or behind a non-backless portion of the backless article of clothing such that they are not visible.

5. The bra garment of claim 1, wherein the bra garment is a brassiere.

6. The bra garment of claim 1, wherein the bra garment is a bandeau.

7. The bra garment of claim 1, wherein the embellished non-elastic portion is made from a material selected from a group consisting of: synthetic fabrics, denim, cotton, leather, plastic, stone, rubber, polyester, satin, suede, natural fur, synthetic fur, vinyl, metal, silk, or combinations thereof.

8. The bra garment of claim 1, wherein the embellished non-elastic portion comprises at least one visible aesthetic design feature.

9. The bra garment of claim 1, wherein the elastic portion comprises one or more hooks and one or more eyelets which the one or more hooks may engage.

10. The bra garment of claim 9, wherein the one or more eyelets comprises a plurality of eyelets positioned at varying lengths along the elastic portion allowing for engagement by the hooks with different ones of the eyelets so the back strap may be tightened or loosened.

11. The bra garment of claim 1, wherein the back strap is interchangeable with other back straps that have different embellished straps with other materials or ornaments, each covering the elastic portion for adjusting the back strap to the wearer.

12. The bra garment of claim 1, wherein the elastic portion loops around to allow the hook on each end to engage with a plurality of opposing loops on a nonvisible back side of the elastic portion, the opposing loops positioned at varying lengths along the nonvisible back side so the back strap may be tightened or loosened, and wherein the embellished non-elastic portion sits on top of the elastic portion.

13. The bra garment of claim 1, further comprising an affixing mechanism that engages the elastic portion so that the embellished non-elastic portion can obfuscate and embellish the elastic portion.

14. The bra garment of claim 1, further comprising a pair of reinforcement members made of rigid material stitched into fabric of the first edge section and a pair of reinforcement members made of rigid material stitched into fabric of the second edge section.

15. The bra garment of claim 14, wherein the pair of reinforcement members on the first edge section are positioned on either side of the first opening and the pair of reinforcement members on the second edge section are positioned on each side of the second opening.

16. The bra garment of claim 15, wherein the pair of reinforcement members are stays or are stiffening elements.

* * * * *